US007523597B2

(12) United States Patent
Dominguez, Jr. et al.

(10) Patent No.: US 7,523,597 B2
(45) Date of Patent: Apr. 28, 2009

(54) APPARATUS AND METHOD FOR MOUNTING A BAG FORMER

(75) Inventors: John Dominguez, Jr., Pasadena, TX (US); John Dominguez, III, Pasadena, TX (US)

(73) Assignee: J & F Business, Inc., Pasadena, TX (US)

( * ) Notice: Subject to any disclaimer, the term of this patent is extended or adjusted under 35 U.S.C. 154(b) by 135 days.

(21) Appl. No.: 11/688,613

(22) Filed: Mar. 20, 2007

(65) Prior Publication Data

US 2008/0229712 A1 Sep. 25, 2008

(51) Int. Cl.
*B65B 9/22* (2006.01)

(52) U.S. Cl. ..... 53/451; 53/551; 493/302; 493/308

(58) Field of Classification Search ..... 53/451, 53/551, 552; 493/302, 308; *B65B 9/20, B65B 9/22*

See application file for complete search history.

(56) References Cited

U.S. PATENT DOCUMENTS 3,067,555 A * 12/1962 Newell et al. ..... 53/551
3,861,121 A * 1/1975 Monsees ..... 53/551
4,090,344 A * 5/1978 Kelly ..... 53/451
4,322,929 A * 4/1982 Neumann ..... 53/451
4,532,754 A 8/1985 Hokanson
4,598,533 A * 7/1986 Takagaki ..... 53/552
4,697,403 A * 10/1987 Simpson et al. ..... 53/551
4,711,068 A 12/1987 Dominguez
4,738,287 A * 4/1988 Klinkel ..... 53/551
4,766,716 A * 8/1988 Dominguez ..... 53/551
4,910,943 A * 3/1990 Taylor et al. ..... 53/551
5,707,329 A * 1/1998 Pool et al. ..... 493/302
5,845,465 A * 12/1998 Bennett ..... 53/551
5,852,920 A * 12/1998 Linkiewicz ..... 53/551
5,924,268 A * 7/1999 Fukuda et al. ..... 53/550
5,983,610 A * 11/1999 Fukuda ..... 53/551
6,041,575 A * 3/2000 Vonderhorst et al. ..... 53/451
6,131,367 A * 10/2000 Fukuda et al. ..... 53/551
6,170,227 B1 * 1/2001 Kovacs et al. ..... 53/551

(Continued)

FOREIGN PATENT DOCUMENTS

EP 1442980 A1 * 8/2004

(Continued)

*Primary Examiner*—Stephen F Gerrity
(74) *Attorney, Agent, or Firm*—Wong, Cabello, Lutsch, Rutherford & Brucculeri, LLP

(57) ABSTRACT

A self-aligning former assembly has a single-point mount for attachment to an automated form/fill/seal packaging machine. Substantially rectangular apertures in a plurality of mounting brackets are configured to fit snugly on corresponding substantially rectangular shoulders formed on a mounting post. The configuration inhibits pivoting motion of the former on the mounting post. In an illustrated embodiment, the mounting post is attached to a base plate with a plurality of spaced-apart fasteners which prevent rotational movement of the mounting post relative to the base plate. Radial attachments are used in the illustrated embodiment to secure the funnel portion of a product feed tube to the mounting apparatus. Paired upper and lower mounting brackets permit precise alignment of the device prior to affixing the radial attachments to the mounting brackets. The disclosed mounting system obviates the need for subsequent adjustment of the former on the packaging system to align the former assembly with the pull-down belts and the longitudinal seal former.

20 Claims, 6 Drawing Sheets

U.S. PATENT DOCUMENTS

| | | | | |
|---|---|---|---|---|
| 6,314,706 | B1 * | 11/2001 | Araki et al. | 53/451 |
| 6,513,308 | B1 * | 2/2003 | Meeuwesen et al. | 53/551 |
| 6,589,147 | B2 | 7/2003 | Dominguez, Jr. et al. | |
| 6,619,018 | B1 * | 9/2003 | Sasaki | 53/551 |
| 7,121,067 | B1 * | 10/2006 | Fukuda et al. | 53/551 |
| 2002/0033006 | A1 * | 3/2002 | Fukuda et al. | 53/551 |
| 2006/0144019 | A1 * | 7/2006 | Kettner et al. | 53/451 |

FOREIGN PATENT DOCUMENTS

| | | | | |
|---|---|---|---|---|
| EP | 1609720 | A1 | * | 12/2005 |
| JP | 3-85208 | A | * | 4/1991 |
| JP | 3-148406 | A | * | 6/1991 |
| JP | 4-154507 | A | * | 5/1992 |
| JP | 10-203502 | A | * | 8/1998 |
| JP | 2000-142636 | A | * | 5/2000 |

* cited by examiner

APPARATUS AND METHOD FOR MOUNTING A BAG FORMER

BACKGROUND OF THE INVENTION

This invention relates generally to product packaging systems. More particularly, it relates to formers used on automated equipment to configure sheet material into individual bags and fill the bags so formed with product.

For speed and economy of operation, the automated form/fill/seal type of bagging system is often chosen for bulk products, particularly foodstuffs. Material in sheet form (for example, a pre-printed, aluminized polymer sheet; TYVEK® spunbonded olefin, a synthetic material made of high-density polyethylene fibers; woven or knitted fabric material comprising natural fibers, synthetic fibers or a blend of natural and synthetic fibers; paper, including coated papers; cardboard and metal foils) is formed into a tube shape, provided with a longitudinal seal, filled with product and then sealed transversely to provide a closed bag. Such a process may be performed with continuous or near-continuous movement of packaging material through the apparatus.

As shown in FIG. 1, a typical product packaging system 100 comprises three major components: the product 105 to be packaged; packaging material 110 from which packages are formed; and former 115. Product 105 may be in a variety of physical forms including, for example, liquids, powders, solids and bulk material. Package material 110 is typically a thin film with text and graphics that identify the product (e.g., potato chips, coffee, candy, etc.) and the brand thereof. Former 115 is an assembly that manipulates package material 110 into the desired shape (e.g., a rectangular or elliptical bag) and configures the various seals that will close the bag, while the packaging system itself provides the product and actually seals package material 110 to form an enclosed volume (packages 120).

FIG. 2 illustrates a typical longitudinal-type packaging system 200. As shown, product 105 and packaging material 110 are introduced to former 115 where material 110 is shaped and aligned by wing 205 to conform about product filing tube 210 and to form a seam. The seam is longitudinally sealed by sealing device 215 so that material 110 forms a cylinder 220. Feeding device 225 pulls packaging material 110 (specifically cylinder 220) downward so that sealing/cutting device 230 may seal cylinder 220 to form product package 120.

Bag forming tools may be welded, formed or solid. Depending on the configuration of the former, a variety of seal configurations are available for the back or longitudinal seal including lap seals, reverse lap seals, fin seals, reverse fin seals, offset fin seals (both standard and reverse), pinch seals and combo seals (both standard and reverse).

Feeding device 225 typically comprises one or more pull-down belts that engage the packaging material between a rotating belt and the side of the product fill tube (or a replaceable wear strip thereon). Pull-down belts for bag-type automated packaging equipment are available in a variety of configurations including plain, grooved, with holes, with countersunk holes, slotted and with a stepped counterbore. Pull-down belts are also available in a variety of materials including, by way of example, polyurethane, natural and synthetic rubber, foam, high-density polyurethane foam, and silicone polymer.

Different bag forming collars are used on both vertical and horizontal form/fill/seal packaging machines to provide the desired type and size of package. Typically, an automated packaging system will comprise one or more removable, replaceable formers so that the packaging system can be used to fabricate and fill a variety of package types and sizes. In the past, aligning the former particularly with the pull-down belts and longitudinal seam former was a difficult and time-consuming task. Even a slight misalignment between the former and the rest of the packaging system can result in malformed packages and/or incomplete seals. The present invention solves this problem.

The fill tubes of former assemblies of the prior art typically were mounted to the base plate of the former with three or more bolts, each of which was inserted through a hole having a diameter larger than that of the bolt. This necessitated careful alignment of the fill tube each time it was removed for cleaning and replaced or when substituting a fill tube of a different size or configuration. The present invention solves this problem.

BRIEF SUMMARY OF THE INVENTION

A self-aligning former assembly has a single-point mount for attachment to an automated packaging machine. In one preferred embodiment, substantially rectangular apertures are configured to fit snugly on a plurality of substantially rectangular shoulders formed on a mounting post. This configuration inhibits any pivoting motion of the former on the mounting post. Other aperture shapes and shoulder shapes which resist rotation about the mounting post may be employed. In one particular preferred embodiment, the mounting post is attached to a base plate with a plurality of spaced-apart fasteners to prevent rotation of the mounting post on the base plate. Radial attachments may be used to secure the funnel portion of a product feed tube to the mounting apparatus. Paired upper and lower mounting brackets permit precise alignment of the device prior to affixing the radial attachments to the mounting brackets. The mounting system of the invention obviates the need for adjusting the former on the packaging system to align the former assembly with the pull-down belts and the longitudinal seal former.

BRIEF DESCRIPTION OF THE SEVERAL VIEWS OF THE DRAWING(S)

DETAILED DESCRIPTION OF THE INVENTION

Figure 1:
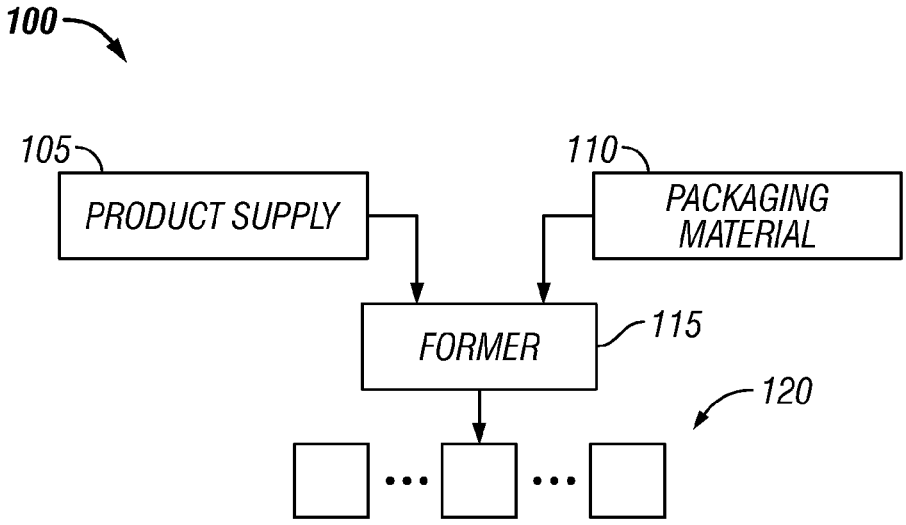
FIG. 1 is a schematic representation of an automated product packaging system.
Figure 2:
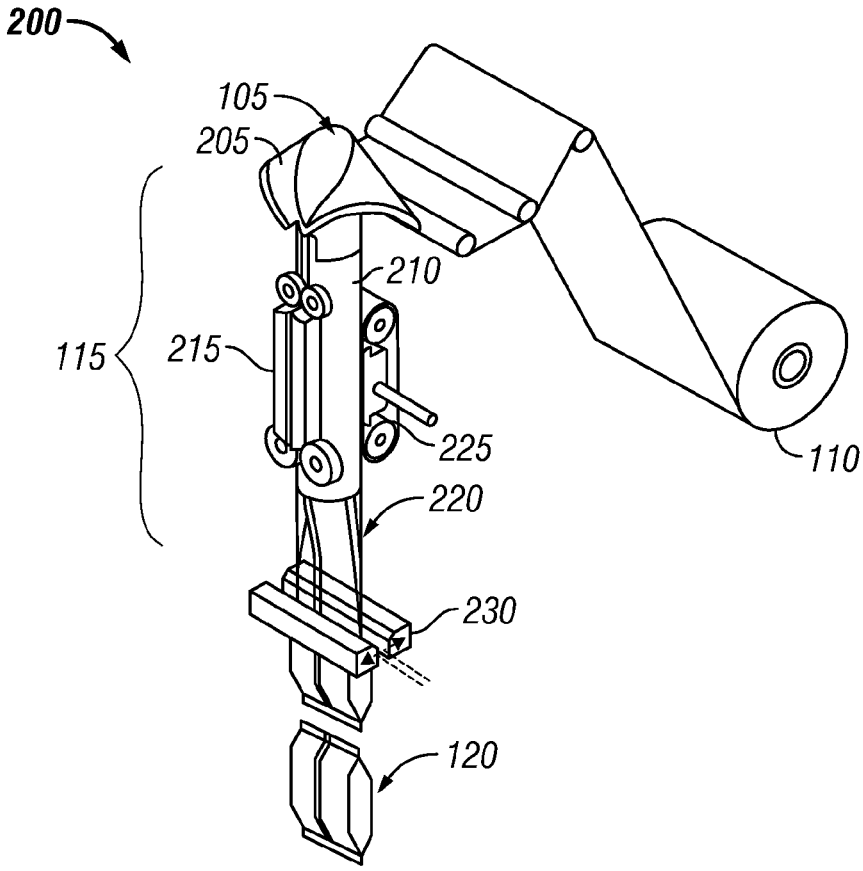
FIG. 2 (Prior Art)
FIG. 2 depicts a typical longitudinal-type packaging system of the prior art.
Figure 3:
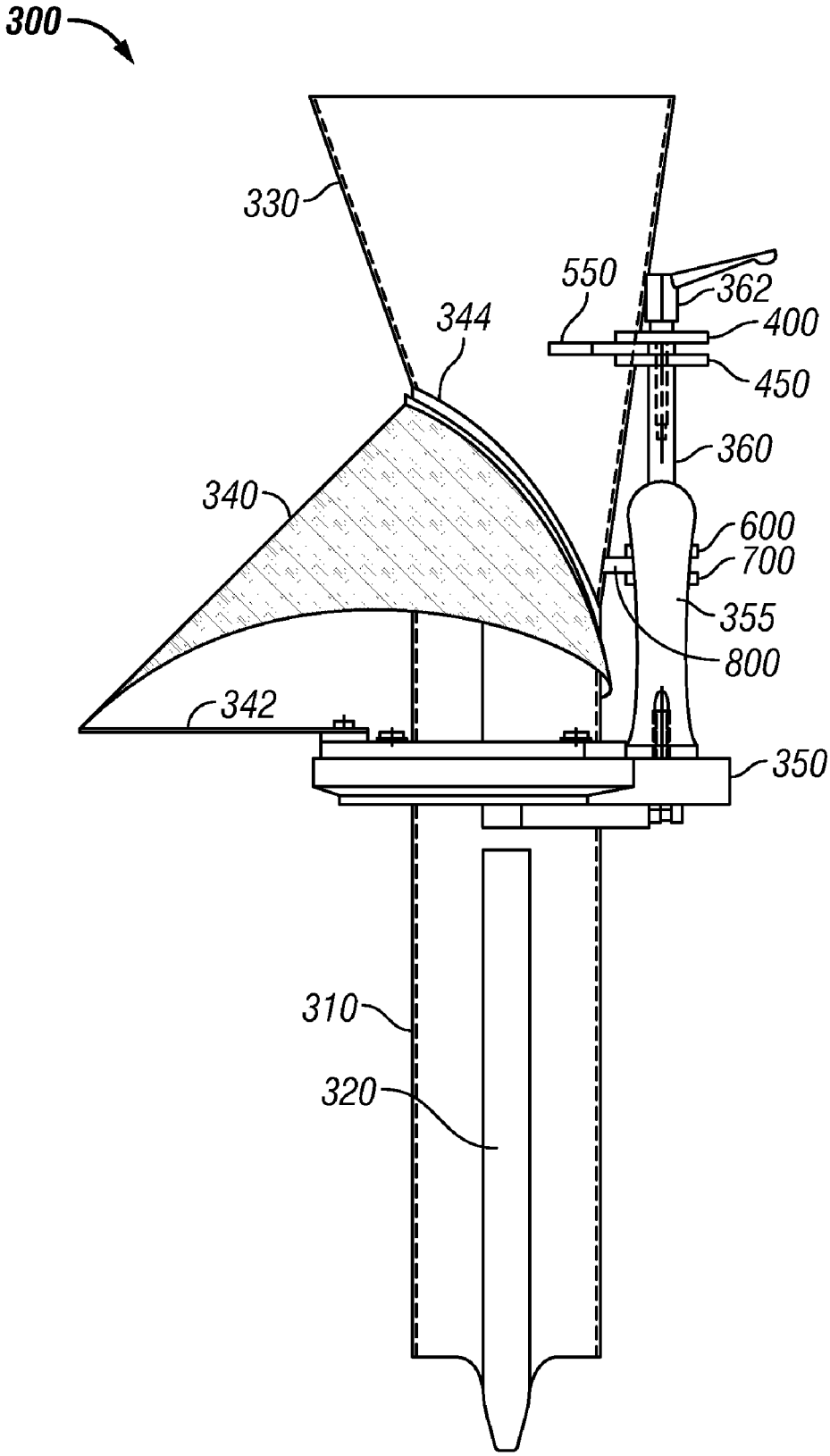
FIG. 3 is a side elevation of one embodiment of the invention.
Figure 4:
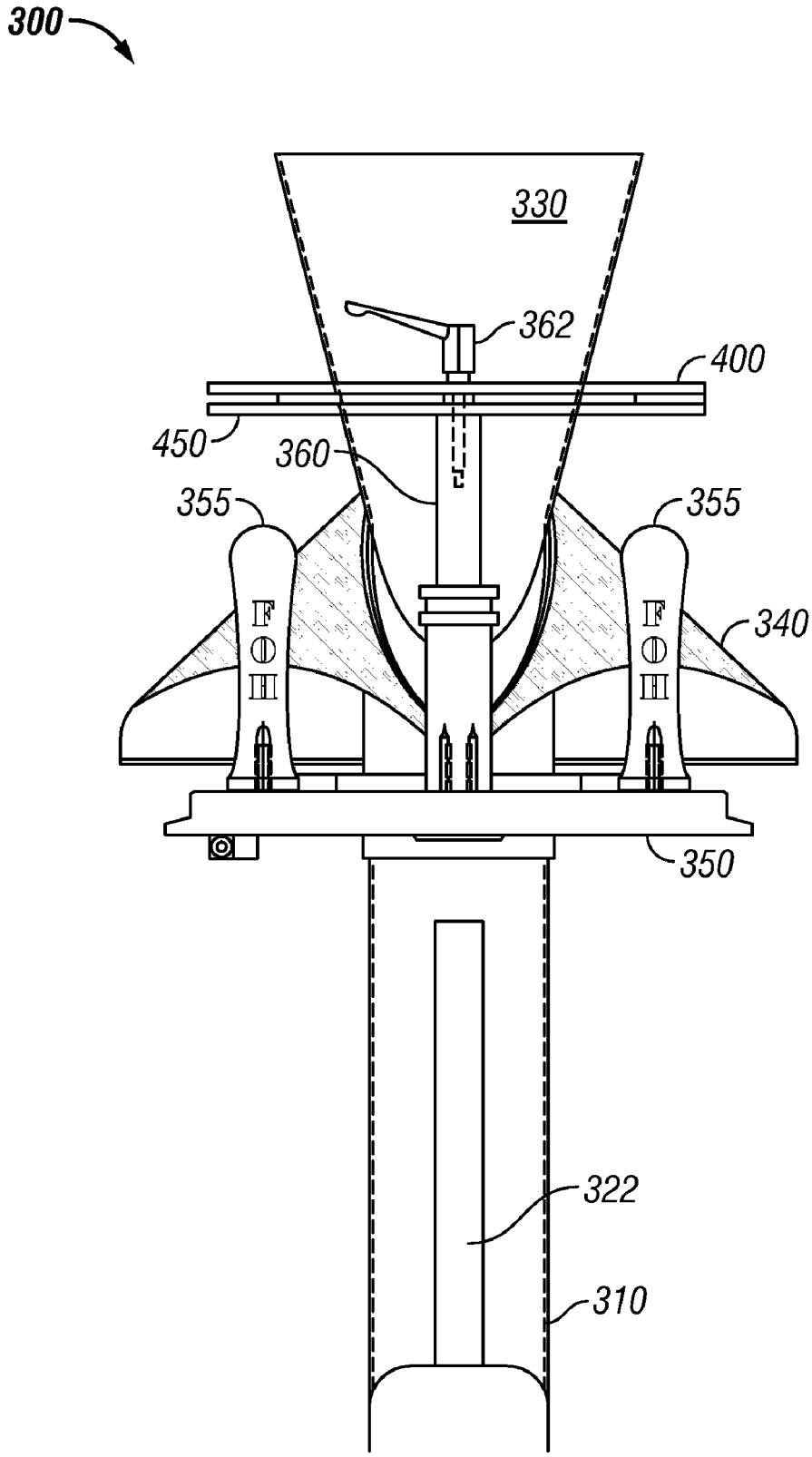
FIG. 4 is a front elevation of the embodiment depicted in FIG. 3.
Figure 5A:
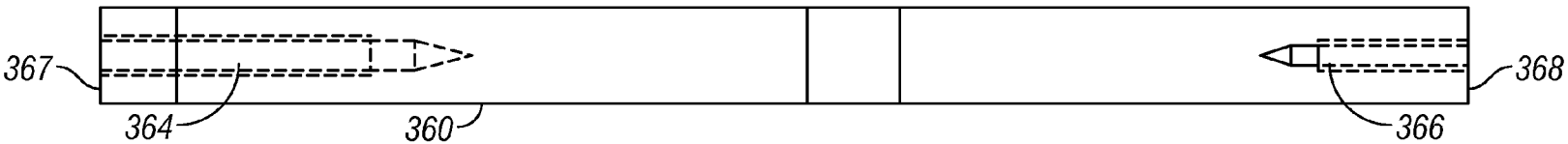
FIGS. 5A through 5D are various views of a mounting post according to one embodiment of the invention.
Figure 5B:
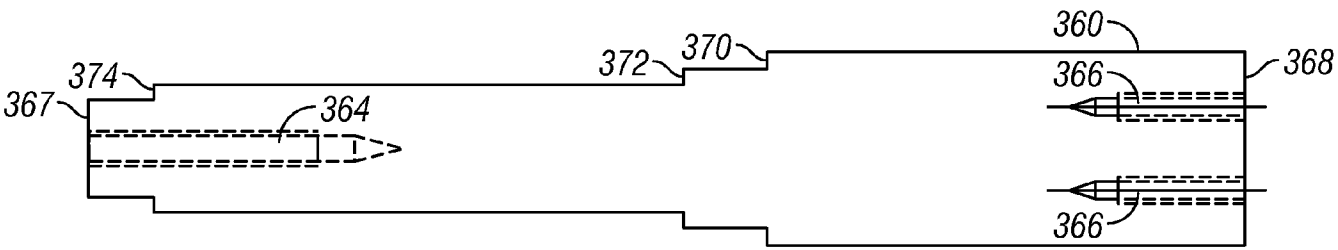
Figure 5C:
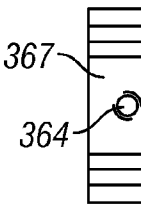
Figure 5D:
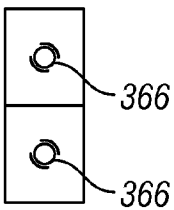

The invention may best be understood by reference to the embodiment illustrated in the drawing figures. In the side elevation of FIG. 3 and the front elevation of FIG. 4, a former assembly 300 according to the present invention may be seen to comprise a generally cylindrical fill tube 310 whose upper portion may have a progressively expanding diameter so as to form funnel section 330 which facilitates entry of product into fill tube 310. Fill tube 310 may also comprise one or more flat sections 320 for increasing the contact area between pull down belts and bagging material [not shown] and/or section 322 for backing longitudinal seam sealer 215 when the former assembly 300 is installed in an automated packaging machine such as that illustrated in FIG. 2.

Base plate 350 provides structural support for the other components of former assembly 300 and may be equipped with conventional means for mounting the assembly on an automated packaging machine. One or more handles or handgrips 355 may be provided on base plate 350 for moving and positioning former assembly 300. A central aperture in base plate 350 [not shown] is sized to accommodate fill tube 310 with an annulus between fill tube 310 and base plate 350. The annulus permits the passage of packaging material through base plate 350 around the outer circumference of fill tube 310.

Base plate 350 also supports former wing 340 by means of wing support 342. As in the former assemblies of the prior art, wing 340 surrounds but does not contact tube 310, leaving gap 344 between the two members for the passage of packaging material.

It will be appreciated that the existence of gap 344 and the annulus in base plate 350 requires that fill tube 310 be suspended from one or more points above base plate 350. The suspension points must also be above gap 344 so as to not interfere with the movement of packaging material across former wing 340. In the illustrated embodiment, the means for mounting fill tube 310 comprises mounting post or stanchion 360 which is attached at its bottom surface 368 to base plate 350 with a plurality of bolts (or other fastening means) so as to prevent any rotation of mounting post 360 on base plate 350. The means for mounting fill tube 310 on former assembly 300 also includes top ear bracket 400, bottom ear bracket 450, top stabilizer ear 600 and bottom stabilizer ear 700, as more fully described below.

Mounting post 360 is shown in FIGS. 5A through 5D, inclusive. In the embodiment illustrated, mounting post 360 has a generally rectangular cross section with an aspect ratio of 12:5 in the lowermost section. The width of mounting post 360 varies stepwise at an intermediate point to form shoulders 370 and 372 and near the upper terminus to create shoulder 374. Threaded sockets 366 which opens to bottom surface 368 are configured to receive mounting bolts for attaching post 360 to base plate 350. Threaded socket 364 which opens to top surface 367 is provided for securing top ear bracket 400 to mounting post 360 by means of a bolt or similar threaded connector.

Figure 6:
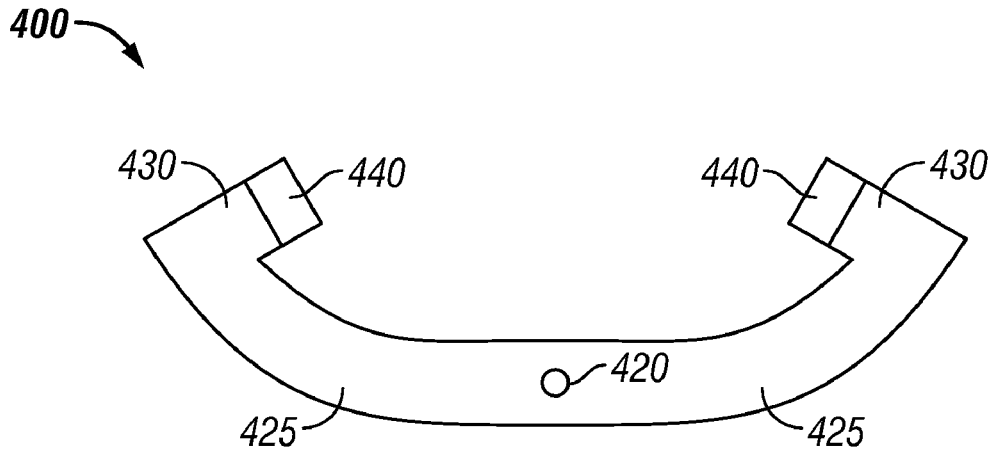
FIG. 6 is a plan view of the top ear bracket of the embodiment illustrated in FIGS. 3 and 4.

Top ear bracket 400 is shown in plan view in FIG. 6. Mounting hole 420 is provided for accommodating a bolt for attachment of top ear bracket 400 to the upper terminus of mounting post 360. Top ear bracket 400 comprises a pair of curved arms 425 at the outer ends of which are ears 430 each having weld area 440 at its distal end. Ears 430 may be approximately perpendicular to arms 425.

Figure 7:
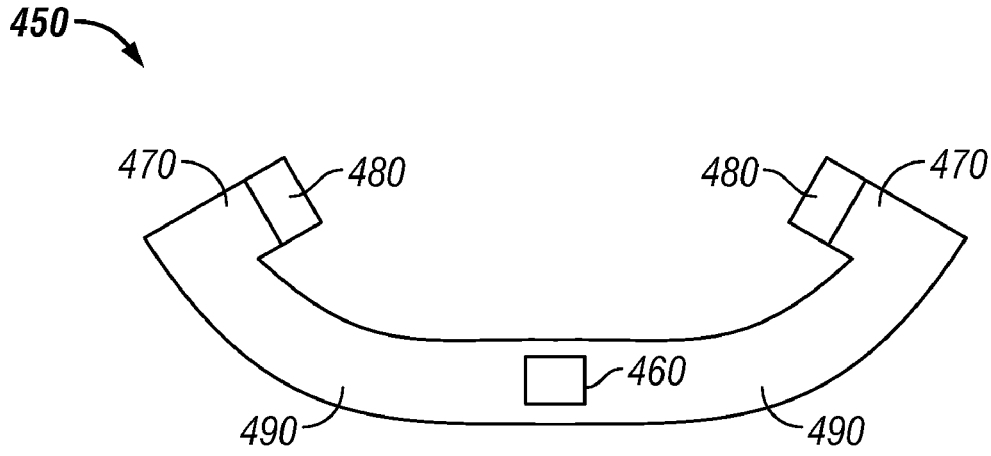
FIG. 7 is a plan view of the bottom ear bracket of the embodiment illustrated in FIGS. 3 and 4.

Bottom ear bracket 450 is shown in plan view in FIG. 7 and is similar to top ear bracket 400 having arms 490 and ears 470 each with weld area 480. However, bottom ear bracket 450 has rectangular aperture 460 which is sized to fit over mounting post 360 and rest upon shoulder 374. In the illustrated embodiment, aperture 460 is oversized by 20 thousandths of an inch in both length and width to fit over mounting post 360.

Figure 8:
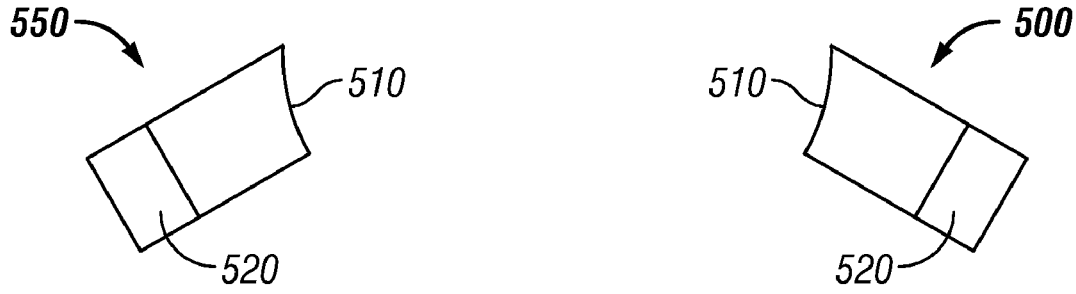
FIG. 8 is a plan view of the left and right side ear brackets of the embodiment illustrated in FIGS. 3 and 4.

Left side ear bracket 550 and right side ear bracket 500 are shown in plan view in FIG. 8. Each of left side ear bracket 550 and right side ear bracket 500 have curved edge 510 which is contoured to fit against the outer surface of funnel section 330 of fill tube 310. Left side ear bracket 550 and right side ear bracket 500 also each have weld area 520 for attachment to ear bracket 400 and bottom ear bracket 450.

The thickness of left side ear bracket 550 and right side ear bracket 500 may be chosen in conjunction with the location of shoulder 374 on mounting post 360 such that left side ear bracket 550 and right side ear bracket 500 are sandwiched between ears 430 of top ear bracket 400 and ears 470 of bottom ear bracket 450 when former 300 is assembled.

Figure 9:
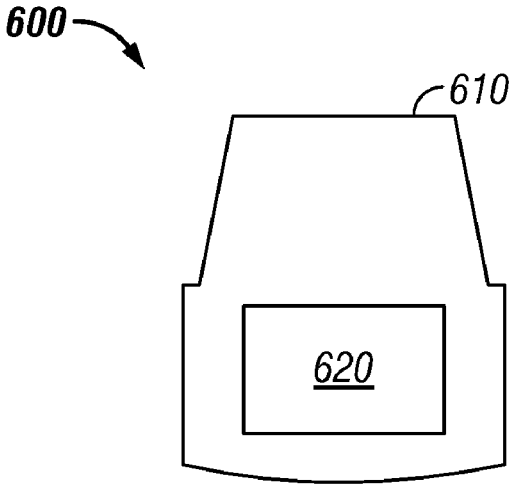
FIG. 9 is a plan view of the top stabilizer ear of the embodiment illustrated in FIGS. 3 and 4.

Top stabilizer ear 600 is shown in plan view in FIG. 9. Top stabilizer ear 600 comprises generally rectangular aperture 620 which is sized to fit on shoulder 372 of mounting post 360. In the illustrated embodiment, aperture 620 is oversized by 20 thousandths of an inch in both length and width to fit over mounting post 360.

Figure 10:
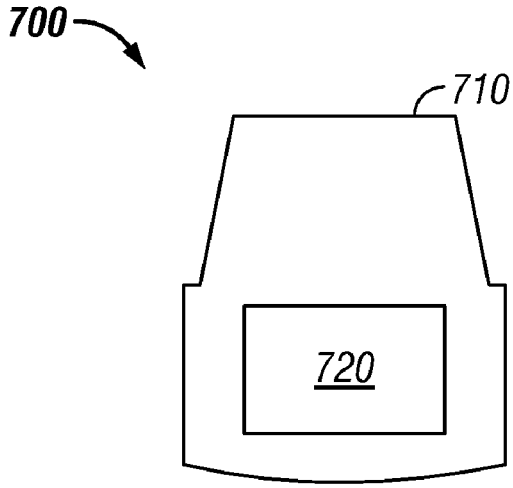
FIG. 10 is a plan view of the bottom stabilizer ear of the embodiment illustrated in FIGS. 3 and 4.

Bottom stabilizer ear 700 is shown in plan view in FIG. 10. Bottom stabilizer ear 700 comprises generally rectangular aperture 720 which is sized to fit on shoulder 370 of mounting post 360. In the illustrated embodiment, aperture 720 is oversized by 20 thousandths of an inch in both length and width to fit over mounting post 360.

Figure 11:
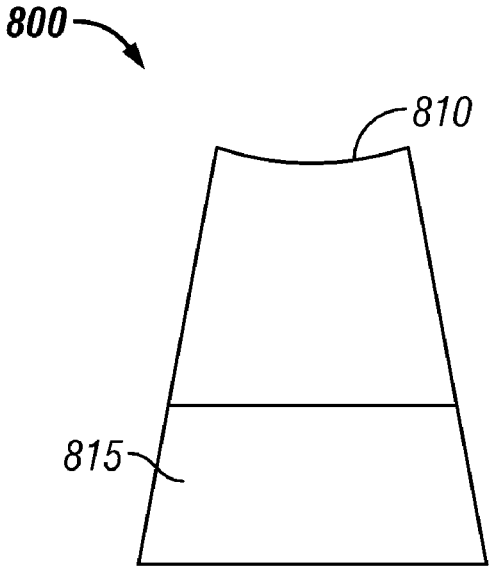
FIG. 11 is a plan view of the stabilizer ear of the embodiment illustrated in FIGS. 3 and 4.

Stabilizer ear 800 is shown in plan view in FIG. 11. Stabilizer ear 800 comprises weld area 815 and has curved edge 810 with radius R which approximates the curve of tube 310 at the point of attachment.

The thickness of top stabilizer ear 600 and bottom stabilizer ear 700 may be chosen in conjunction with the location of shoulders 370 and 372 on mounting post 360 such that stabilizer ear 800 is sandwiched between top stabilizer ear 700 and bottom stabilizer ear 800 when former 300 is assembled.

Former assembly 300 may be made self-aligning by attaching stabilizer ear 800 and side ear brackets 500 and 550 to fill tube 310. In one particular preferred embodiment, all the components are fabricated from stainless steel and stabilizer ear 800 and side ear brackets 500 and 550 are welded to fill tube 310. Bottom stabilizer ear 700 is placed on mounting post 360 at shoulder 370. Top stabilizer ear 600 is placed on mounting post 360 at shoulder 372. Bottom ear bracket 450 is placed on mounting post 360 at shoulder 374 and top ear bracket 400 is bolted to top surface 367 of mounting post 360 using captive socket wrench 362.

Fill tube 310 may now be placed in the desired, fully-aligned position. A fixture may be used for alignment or, in the alternative, former 300 may be mounted on an automated packaging machine. Shims, clamps or other means well known in the art may be used to stabilize fill tube in the desired, aligned position. As fill tube 310 is positioned and aligned, stabilizer ears side ear brackets 500 and 550 may slide between top and bottom ear brackets 400 and 450 and stabilizer ear 800 may slide between top and bottom stabilizer ears 600 and 700. The vertical position of fill tube 310 relative to base plate 350 is less critical to performance than the alignment of fill tube 310 in the left and right and fore and aft directions and in the tilt of the axis. Thus, the dimensions of mounting post 360 and the mounting planes of side ear brackets 500 and 550 and stabilizer ear 800 have been found to be sufficient to fix the height of fill tube 310. When alignment is complete, stabilizer ear 800 may then be welded to top and bottom stabilizer ears 600 and 700, respectively. Similarly, side ear brackets 500 and 550 may be welded to ears 430 and 470 respectively of top ear bracket 400 and bottom ear bracket 450. In this way, the alignment of fill tube 310 with respect to base plate 350 is substantially fixed and fill tube 310 may be removed (as for cleaning) by simply removing the bolt from threaded hole 364 of mounting post 360 (as with captive wrench 362) and lifting it off of mounting post 360. Replacement of fill tube 360 may be accomplished by reversing the above-described steps and the alignment of fill tube 360 is restored without the need for manual adjustment.

Although the invention has been described in detail with reference to certain preferred embodiments, variations and modifications exist within the scope and spirit of the invention as described and defined in the following claims. For example, the illustrated embodiments have been described as having their component parts welded together. This is not necessary. Any means of affixing components together may be used (e.g., glue, lamination, bolting and the like). Other modifications will be recognized by those of ordinary skill in the art.

The invention claimed is:

1. A former assembly for fabricating bags from flexible sheet material comprising:

a base plate having an aperture extending from a first surface to a second surface thereof;

a single mounting post attached to the base plate on the first surface proximate the aperture;

a substantially rigid tube slidably attached to the mounting post at a plurality of non-contiguous, spaced-apart locations such that the tube extends through the aperture in the base plate with an annular space between the tube and the base plate sized for the passage of the flexible sheet material.

2. A former assembly as recited in claim 1 wherein the mounting post is substantially rectangular in cross section.

3. A former assembly as recited in claim 2 wherein the mounting post is attached to the base plate with a plurality of fasteners such that rotation of the mounting post about its longitudinal axis is inhibited.

4. A former assembly as recited in claim 1 wherein the mounting post has at least one shoulder at a point intermediate the top and bottom thereof.

5. A former assembly as recited in claim 1 wherein the mounting post has at least three shoulders at three points intermediate the top and bottom thereof.

6. A former assembly as recited in claim 5 wherein the mounting post is substantially rectangular in cross section.

7. A former assembly as recited in claim 1 wherein the substantially rigid tube is releasably attached to the mounting post.

8. A former assembly as recited in claim 1 wherein the substantially rigid tube is attached to the mounting post at three spaced-apart locations.

9. A former assembly as recited in claim 8 wherein two of the attachment locations are in a first plane and one attachment location is in a second plane, the first and second planes being substantially perpendicular to the axis of the tube.

10. A former assembly as recited in claim 1 additionally comprising a first arm attached to the tube at two, spaced-apart locations and to the mounting post at a first location.

11. A former assembly as recited in claim 10 further comprising a second arm, substantially parallel to the first arm attached to the tube at two, spaced-apart locations and to the mounting post at a second location.

12. A former assembly as recited in claim 10 further comprising a second arm attached to the tube at a point approximately equidistant from the two, spaced apart locations and to the mounting post at a second location.

13. A former assembly as recited in claim 12 wherein the second location on the mounting post is defined by a shoulder on the mounting post and the second arm is adapted to slide on the mounting post.

14. A former assembly for fabricating bags from flexible sheet material comprising:

a base plate having an aperture extending from a first surface to a second surface thereof;

a substantially rectangular mounting post attached to the base plate on the first surface proximate the aperture such that rotation of the mounting post relative to the base plate is inhibited, the mounting post having a first shoulder intermediate the top and bottom of the mounting post, a second shoulder intermediate the first shoulder and top of the mounting post and a third shoulder intermediate the second shoulder and the top of the mounting post;

a first bracket having a substantially rectangular aperture sized to slide on the mounting post and rest on the first shoulder;

a second bracket having a substantially rectangular aperture sized to slide on the mounting post and rest on the second shoulder;

a third bracket having a substantially rectangular aperture sized to slide on the mounting post and rest on the third shoulder;

a fourth bracket having a substantially round aperture sized and positioned to receive a bolt for securing the fourth bracket to the top of the mounting post;

a substantially rigid tube having first, second and third radial projections sized and spaced such that the first and second radial projections each attach to both the first and second brackets and the third radial projection attaches to both the third and fourth bracket such that when the first, second, third and fourth brackets are positioned on the mounting post, the tube extends through the aperture in the base plate with an annular space between the tube and the base plate sized for the passage of the flexible sheet material.

15. A method of aligning a fill tube on former assembly for fabricating bags from flexible sheet material comprising:

providing a base plate having an aperture extending from a first surface to a second surface thereof;

providing a substantially rectangular mounting post attached to the base plate on the first surface proximate the aperture such that rotation of the mounting post relative to the base plate is inhibited, the mounting post having a first shoulder intermediate the top and bottom of the mounting post, a second shoulder intermediate the first shoulder and top of the mounting post and a third shoulder intermediate the second shoulder and the top of the mounting post;

providing a first bracket having a substantially rectangular aperture sized to slide on the mounting post and rest on the first shoulder;

providing a second bracket having a substantially rectangular aperture sized to slide on the mounting post and rest on the second shoulder;

providing a third bracket having a substantially rectangular aperture sized to slide on the mounting post and rest on the third shoulder;

providing a fourth bracket having a substantially round aperture sized and positioned to receive a bolt for securing the fourth bracket to the top of the mounting post;

providing a substantially rigid tube having first, second and third radial projections sized and spaced such that the first and second radial projections slide between the first and second brackets and the third radial projection slides between the third and fourth brackets when the tube is properly aligned relative to the base plate and when the first, second, third and fourth brackets are positioned on the mounting post;

aligning the tube such that, the tube extends through the aperture in the base plate with an annular space between the tube and the base plate sized for the passage of the flexible sheet material; and affixing first and second radial projections to the first and second brackets and affixing the third radial projection to the third and fourth brackets.

16. A method as recited in claim 15 wherein the aligning is accomplished with a fixture.

17. A method as recited in claim 15 wherein the aligning is accomplished with the base plate mounted on an automatic packaging machine.

18. A former assembly adapted for reproducible positioning on automated equipment for fabricating bags from flexible sheet material and filing said bags with a selected product comprising:

a base plate having an aperture extending from a first surface to a second surface thereof;

a mounting post attached to the base plate on the first surface proximate the aperture, the mounting post having a polygonal cross section with a plurality of spaced-apart shoulders;

a substantially rigid tube with a plurality of brackets connected to the tube, each bracket having a polygonal aperture sized and spaced to permit sliding engagement with the mounting post at a selected shoulder such that rotation of bracket relative to the tube is prevented and, when the brackets are resting on their respective shoulders of the mounting post, the tube extends through the aperture in the base plate with an annular space between the tube and the base plate sized for the passage of the flexible sheet material.

19. A former assembly as recited in claim 18 wherein the mounting post has a rectangular cross section and polygonal apertures in the plurality of brackets are rectangular.

20. A method for reproducibly positioning a fill tube on a bag former assembly having a flexible sheet pull-down mechanism said method comprising:

providing a base plate having an aperture extending from a first surface to a second surface thereof;

providing a substantially rectangular mounting post attached to the base plate on the first surface proximate the aperture such that rotation of the mounting post relative to the base plate is inhibited, the mounting post having a first shoulder intermediate the top and bottom of the mounting post, a second shoulder intermediate the first shoulder and top of the mounting post and a third shoulder intermediate the second shoulder and the top of the mounting post;

providing a first bracket having a substantially rectangular aperture sized to slide on the mounting post and rest on the first shoulder;

providing a second bracket having a substantially rectangular aperture sized to slide on the mounting post and rest on the second shoulder;

providing a third bracket having a substantially rectangular aperture sized to slide on the mounting post and rest on the third shoulder;

providing a fourth bracket having a substantially round aperture sized and positioned to receive a fastener for securing the fourth bracket to the top of the mounting post;

providing a substantially rigid tube having first, second and third radial projections with the first and second radial projections each connected to both the first and second brackets and the third radial projection connected to both the third and fourth brackets such that when the brackets are positioned on the shoulders of the mounting post, the tube is aligned relative to the sheet material pull-down mechanism such that flexible sheet material pulled across the outer surface of the tube by the pull-down mechanism is pulled in a direction parallel to the longitudinal axis of the tube.

* * * * *